US011435676B2

(12) United States Patent
Ambar et al.

(10) Patent No.: US 11,435,676 B2
(45) Date of Patent: Sep. 6, 2022

(54) FOCUS ADJUSTMENT IN PRINT APPARATUS

(71) Applicant: Hewlett-Packard Development Company, L.P., Spring, TX (US)

(72) Inventors: Oron Ambar, Ness Ziona (IL); Zvi Erlich, Ness Ziona (IL); Haim Vladomirski, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/418,024

(22) PCT Filed: May 31, 2019

(86) PCT No.: PCT/US2019/035004

§ 371 (c)(1),
(2) Date: Jun. 24, 2021

(87) PCT Pub. No.: WO2020/242501

PCT Pub. Date: Dec. 3, 2020

(65) Prior Publication Data

US 2022/0091535 A1 Mar. 24, 2022

(51) Int. Cl.
*G03G 15/043* (2006.01)

(52) U.S. Cl.
CPC ..... *G03G 15/043* (2013.01)

(58) Field of Classification Search
CPC ..... G03G 15/0415; G03G 15/043; G03G 15/04054; G03G 15/04063
See application file for complete search history.

(56) References Cited

U.S. PATENT DOCUMENTS 6,717,606 B2 4/2004 Masuda
8,965,244 B2 2/2015 Shimizu
(Continued)

FOREIGN PATENT DOCUMENTS

JP 2002361923 A 12/2002
JP 2007022060 A 2/2007

*Primary Examiner* — Carla J Therrien
(74) *Attorney, Agent, or Firm* — Steven R. Ormiston

(57) ABSTRACT

A focus adjustment method is disclosed. The focus adjustment method includes depositing, using a print apparatus, print agent onto a printable substrate, the print apparatus comprising a photoconductive surface and a writing head having a first end and a second end, the writing head having an array of light sources to emit radiation onto the photoconductive surface during a printing operation. The method also includes during said depositing, moving the writing head relative to the photoconductive surface, between a first position and a second position, to create a printed image. The method also includes determining, based on the printed image, for each of a plurality of locations along the writing head, a position of the writing head relative to the photoconductive surface at which the writing head is most focussed. The method also includes calculating, using processing apparatus, a position of the first end of the writing head and a position of the second end of the writing head relative to the photoconductive surface at which the focus of the writing head at the plurality of locations is within a defined threshold. The method also includes adjusting the position of the first end of the writing head and the second end of the writing head relative to the photoconductive surface according to the calculated positions. A print apparatus and the machine-readable medium are also disclosed.

14 Claims, 7 Drawing Sheets

(56) References Cited

U.S. PATENT DOCUMENTS

| | | | | |
|---|---|---|---|---|
| 9,201,335 | B2 | 12/2015 | Judd et al. | |
| 9,341,979 | B1 | 5/2016 | Tamarez Gomez et al. | |
| 9,712,712 | B1 | 7/2017 | Kuo et al. | |
| 2011/0199662 | A1 | 8/2011 | Yasuda et al. | |
| 2015/0109397 | A1* | 4/2015 | Makishima | G03G 15/043 347/118 |
| 2015/0165785 | A1* | 6/2015 | Washington | G03G 15/5041 347/134 |

* cited by examiner

FOCUS ADJUSTMENT IN PRINT APPARATUS

BACKGROUND

In some printing systems, components are capable of moving relative to one another. If a particular component is not in an intended position relative to another component, then a print defect may occur in the resulting printed output.

In one particular type of printing system, liquid electrophotography (LEP) printing techniques may be used. An LEP print apparatus may include a photoconductive surface positioned relative to a light-emitting "writing head" which selectively discharges portion of the photoconductive surface that are to receive print agent.

BRIEF DESCRIPTION OF DRAWINGS

Examples will now be described, by way of non-limiting example, with reference to the accompanying drawings, in which.

DETAILED DESCRIPTION

In a liquid electrophotography (LEP) print apparatus, print agent, such as ink, may pass through a print agent application assembly, such as a binary ink developer (BID). Each BID handles print agent of a particular colour, so an LEP printing system may include, for example, seven BI Ds. Print agent from a BID is selectively transferred from a print agent transfer roller—also referred to as a developer roller—of the BID in a layer of substantially uniform thickness to a photoconductive surface, such as a photo imaging plate (PIP). The selective transfer of print agent is achieved through the use of an electrically-charged print agent, also referred to as a "liquid electrophotographic ink". As used herein, a "liquid electrophotographic ink" or "LEP ink" generally refers to an ink composition, in liquid form, generally suitable for use in a liquid electrostatic printing process, such as an LEP printing process. The LEP ink may include chargeable particles of a resin and a pigment/colourant dispersed in a liquid carrier.

The LEP inks referred to herein may comprise a colourant and a thermoplastic resin dispersed in a carrier liquid. In some examples, the thermoplastic resin may comprise a copolymer of an alkylene monomer and a monomer selected from acrylic acid and methacrylic acid. In some examples, the thermoplastic resin may comprise a copolymer of an ethylene acrylic acid resin, an ethylene methacrylic acid resin or combinations thereof. In some examples, the thermoplastic resin may comprise an ethylene acrylic acid resin, an ethylene methacrylic acid resin or combinations thereof. In some examples, the carrier liquid is a hydrocarbon carrier liquid such as an isoparaffinic carrier liquid, for example Isopar-L™ (available form EXXON CORPORATION). In some examples, the electrostatic ink also comprises a charge director and/or a charge adjuvant. In some examples, the charge adjuvant includes aluminum di- or tristearate. In some examples, the liquid electrostatic inks described herein may be Electrolnk® and any other Liquid Electro Photographic (LEP) inks developed by Hewlett-Packard Company.

Figure 1:
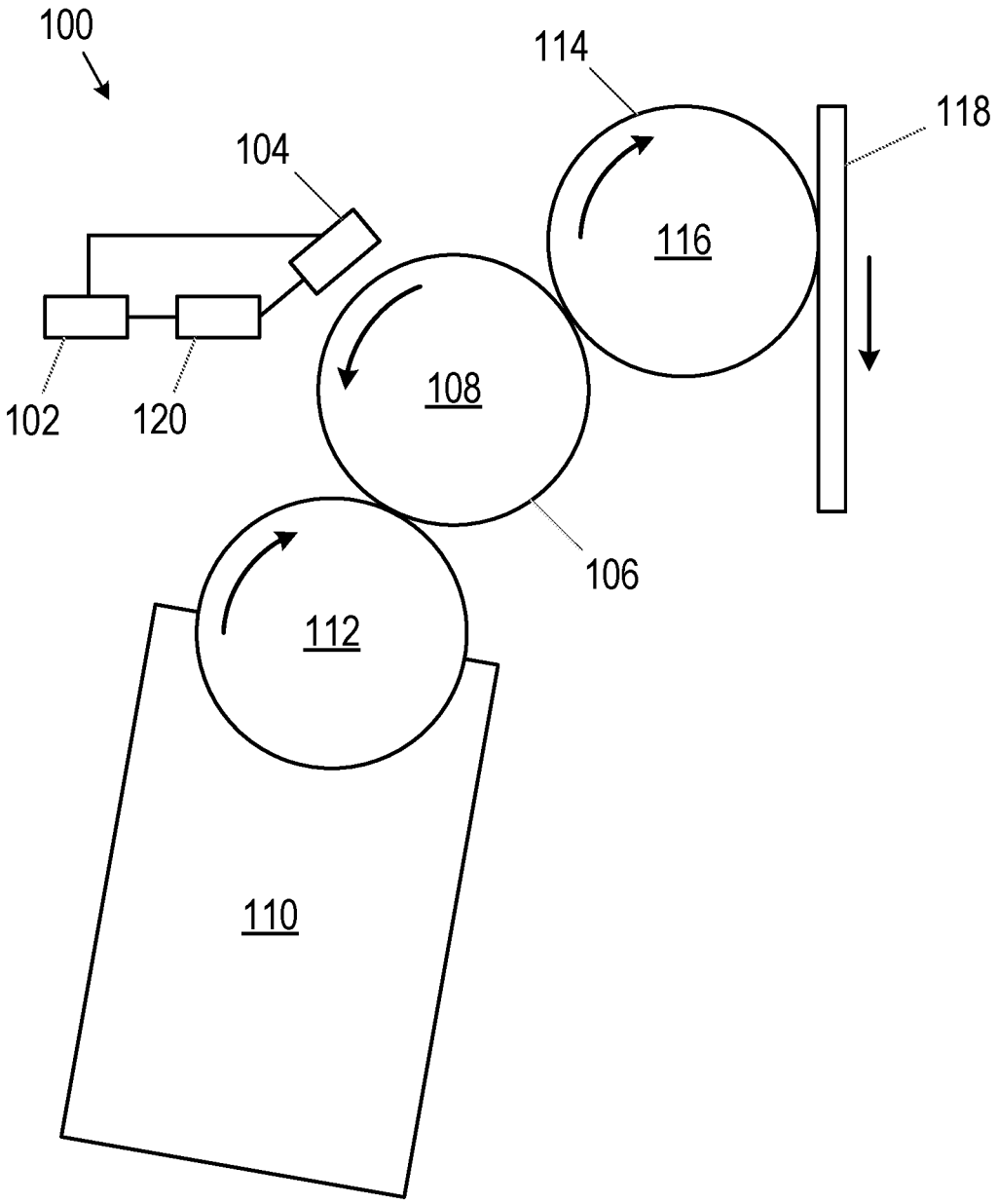
FIG. 1 is a schematic illustration of an example of a liquid electrophotography print apparatus.

Referring now to the drawings, FIG. 1 is a schematic illustration of various components of a print apparatus. Aspects of the present disclosure may be applicable to liquid electrophotography print apparatus, and various examples are described in relation to such print apparatuses. However, it will be understood that the present disclosure is also relevant to other types of print apparatuses. FIG. 1 shows the components of a print apparatus 100. Data representing an image to be printed is received by a processor 102, which controls a print head, or writing head, 104 to form a latent image on a photoconductive surface 106. The photoconductive surface 106 may, in some examples, comprise the surface of a drum or roller 108, or the surface of a belt wrapped around multiple rollers. In other examples, the photoconductive surface 106 may comprise the surface of a blanket which may, for example, be formed on or around the drum or roller 108.

The writing head 104 comprises a plurality of light sources (not shown in FIG. 1) which, under control of processing circuitry (e.g. the processor 102), direct radiation onto the photoconductive surface 106 according to the image to be printed, to selectively discharge the photoconductive surface in portions that are to receive print agent. The writing head 104 may also include an optical element to focus the radiation emitted from the light sources. In some examples, a single optical element may be used to focus light from multiple light sources while, in other examples, each light source may have a corresponding optical element to focus its radiation. The optical element may, in some examples, comprise a lens or multiple lenses. In examples where multiple elements are provided, a lens array may be positioned near to, or adjacent to, the light sources to focus the emitted radiation. The purpose of the optical element(s) is to focus radiation from the light sources onto the photoconductive surface 106, so that the resulting printed image appears clear and sharp.

Once a latent image has been formed on the photoconductive surface 106, print agent (e.g. electrically charged LEP ink) is selectively transferred onto the charged regions of the photoconductive surface. In the example shown, print agent is provided from a print agent application assembly 110, also referred to as a binary ink developer, or BID. The print agent application assembly 110 includes various components in addition to those shown, which transfer print agent onto a developer roller 112. In the example shown, the developer roller 112 rotates in a direction opposite to the direction of rotation of the roller 108, as shown by the arrows in FIG. 1. Print agent is transferred from the developer roller 112 onto the discharged portions of the photoconductive surface 106 and, subsequently, onto a transfer medium 114, sometimes referred to as an intermediate transfer medium, or ITM. The transfer medium 114 may comprise a surface of drum or roller 116 which may, in some examples, be referred to as a blanket drum. In other examples, the transfer medium 114 may be formed around the drum or roller 116. The roller 116 rotates in a direction opposite to the direction of rotation of the roller 108 and, as it rotates, print agent in the intended image to be printed is transferred from the transfer medium 114 onto a printable substrate 118 moving relative to the transfer medium.

In some examples, print agent of different colours may individually be transferred (e.g. each colour from a separate print agent application assembly 110) onto a single photoconductive surface 106. In other examples, a print apparatus may include a separate photoconductive surface 106 and corresponding writing head 104 for each colour of print agent.

As noted above, the writing head 104 may, in some examples, include a plurality of light sources which are to emit radiation through a lens array onto the photoconductive surface 106. If the writing head 104 (e.g. as a result of the arrangement of the light sources and the lens array) is properly focused on the photoconductive surface 106, then a diameter of a spot of the radiation (e.g. light) from the light source on the photoconductive surface will be at its minimum (i.e. a minimum spot diameter). However, if light from a light source is not properly focused on the photoconductive surface 106, then the spot diameter size will be larger, which will result in a lower optical resolution. As noted above, those regions of the photoconductive surface 106 that receive radiation from the light sources of the writing head 104 becomes discharged and will receive print agent from the print agent application assembly 110. Therefore, smaller spot sizes of lights on the photoconductive surface 106 will correspond to smaller spot of print agent transferred onto the printable substrate 118. Similarly, a larger spot size of light on the photoconductive surface 106 (e.g., formed from an out-of-focus light source in the writing head 104) will results in a larger spot of print agent transferred onto the printable substrate 118. A sharper image may, therefore, be formed on the printable substrate 118 if smaller spot sizes of light are directed onto the photoconductive surface 106.

Generally, the optical component (e.g. a lens array) will be installed in the writing head 104 relative to the light sources when the writing head is manufactured or assembled. Therefore, due to manufacturing tolerances and inconsistencies, some of the light sources may be focused differently to other light sources in the same writing head. Thus, once the writing head 104 is installed in position relative to the photoconductive surface 106, there exists the possibility that some of the light sources will be focused on the photoconductive surface while other light sources will not be in focus. To adjust the focus of the light sources of the writing head 104, an adjustment mechanism 120 is provided. The adjustment mechanism 120, which may be controlled by processing circuitry, such as the processor 102, may adjust the position of the writing head 104 relative to the photoconductive surface 106 by varying the distance of the writing head from the photoconductive surface. In general, therefore, the adjustment mechanism 120 may move the writing head 104 into a position (i.e. to a particular distance from the photoconductive surface 106) where the light sources are most focused on the photoconductive surface.

The writing head 104 may, in some examples, have a width largely corresponding to (e.g. approximately the same as) a width of the photoconductive surface 106. In other words, the light sources extend substantially over the width of the photoconductive surface 106. In some examples, the extent of the light sources and/or the width of the photoconductive surface 106 may correspond to the maximum width of printable substrate that can be processed (e.g. printed on) by the print apparatus 100. The adjustment mechanism 120 may, in some examples, be capable of moving the writing head 104 as a single unit; that is to say both ends of the writing head may be moved simultaneously by the same amount relative to the photoconductive surface 106. In other examples, however, a first end of the writing head 104 and a second end of the writing head may be moved independently relative to the photoconductive surface, such that a surface of the writing head (e.g. the surface on which the light sources are mounted) is not parallel to (or substantially parallel to) the photoconductive surface. To effect separate and independent movement of each end of the writing head 104, each end may, in some examples, be provided with or connected to, or may otherwise be operated by, a separate adjustment mechanism 120. Thus, in some examples, the print apparatus 100 may comprise multiple adjustment mechanisms 120. In one example, the single adjustment mechanism 120 may be capable of moving each end of the writing head 104 independently. The adjustment mechanism 120 may, in some examples, comprise a motor.

As will be apparent, due to the above-mentioned manufacturing tolerances and inconsistencies in the writing head 104, while one light source in the writing head may be perfectly in focus on the photoconductive surface 106, other light sources in the plurality of light sources may not be so well focused. The present disclosure provides a mechanism by which a position of the writing head relative to the photoconductive surface may be determined which all of the light sources may be focused within a defined range.

Figure 2:
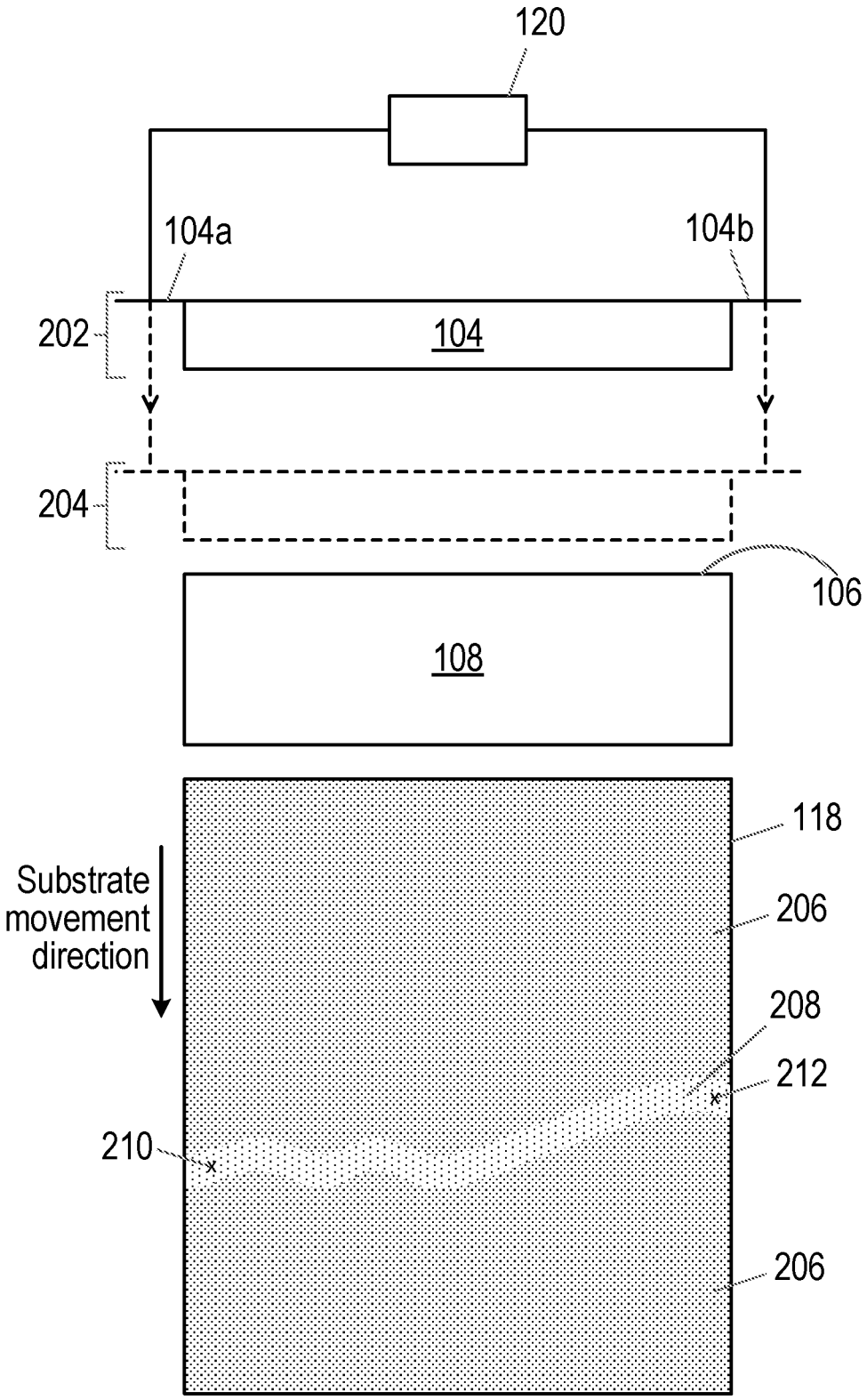
FIG. 2 is a schematic illustration of an example of part of a focus adjustment process being performed.

FIG. 2 is a schematic illustration of an example of part of a focus adjustment process. FIG. 2 shows the writing head 104 movable between a first, distal position 202 and a second, proximal position 204 relative to the photoconductive surface 106. In FIG. 2, the writing head 104 is shown in its second, proximal position 204 with dashed lines. As in the example shown in FIG. 1, the photoconductive surface 106 is, in this example, formed on or around a surface of a roller or drum 108. The adjustment mechanism 120 serves, in this example, to adjust a position of a first end 104*a* of the writing head and a second end 104*b* of the writing head relative to the photoconductive surface. Therefore, in addition to the distal position 202 and the proximal position 204, the writing head 104 may be moved into a position with one of the ends 104*a*, 104*b* closer to the photoconductive surface 106 than the other.

Examples of the focus adjustment process disclosed herein involve printing spots of print agent onto a printable substrate as the position of the writing head 104 is varied between the distal position 202 and the proximal position 204. This may be achieved by controlling the adjustment mechanism 120 to move the writing head 104 from its distal position 202, towards the photoconductive surface 106, into the proximal position 204, while the printable substrate 118 is printed. In other words, while the writing head 104 is moved towards the photoconductive surface 106, spots of radiation from the light sources are directed onto the photoconductive surface 106. As the writing head 104 moves towards the photoconductive surface 106, each light source in the plurality of light sources will transition between a position in which the light source is out of focus, and a position in which the light source is in focus. In other words, while the writing head 104 is moving from the distal position to the proximal position, each light source will be out of focus for the majority of the transition, but will, at some point, be in an optimal, in-focus position. As noted above, when a light source is out of focus (e.g. its focal point does not coincide with photoconductive surface 106) then larger than optimal light spot will be incident on the photoconductive surface, and a corresponding larger than optimal spot of print agent will be deposited onto the printable substrate 118. However, when a light source is in focus (e.g. its focal point coincides with the photoconductive surface 106) then a relatively small light spot will be incident on the photoconductive surface, and the corresponding relatively small spot of print agent will be deposited onto the printable substrate 118. If a light source is then moved into a position where it is again out of focus, then the resulting spot of print agent transferred onto the printable substrate 118 will be relatively large.

A resulting pattern printed onto the printable substrate 118 may be used to determine the position of each light source on the writing head 114 which the light source is in focus (e.g. is focused to its greatest extent). FIG. 2 shows an example of the substrate 118 having been printed while the writing head 104 was moved between the distal position 202 and the proximal position 204. Shaded regions 206 of the printable substrate 118 represent those regions where large spots of print agent have been transferred, caused by corresponding light sources on the writing head 104 being out of focus. An unshaded region 208 of the printable substrate 118 represents a region where relatively smaller spots of print agent have been transferred, caused by corresponding light sources on the writing head 104 being in focus.

From knowledge of the position of the writing head 104 relative to the photoconductive surface 106 that resulted in the relatively smaller spots of print agent on the printable substrate 118, it is possible to determine the general position of the first end 104*a* and the second end 104*b* of the writing head 104 relative to the photoconductive surface 106 at which the light sources are in focus. Such a determination may be made manually, for example by an operator visually inspecting the printed image on the printable substrate 118, or automatically, using a scanner and/or a densitometer. Image processing techniques may also be used in making the determination. A more precise position of the writing head 104 may be determined account the focus of various light sources in the writing head as will now be discussed with reference to FIGS. 3 and 4.

Figure 3:
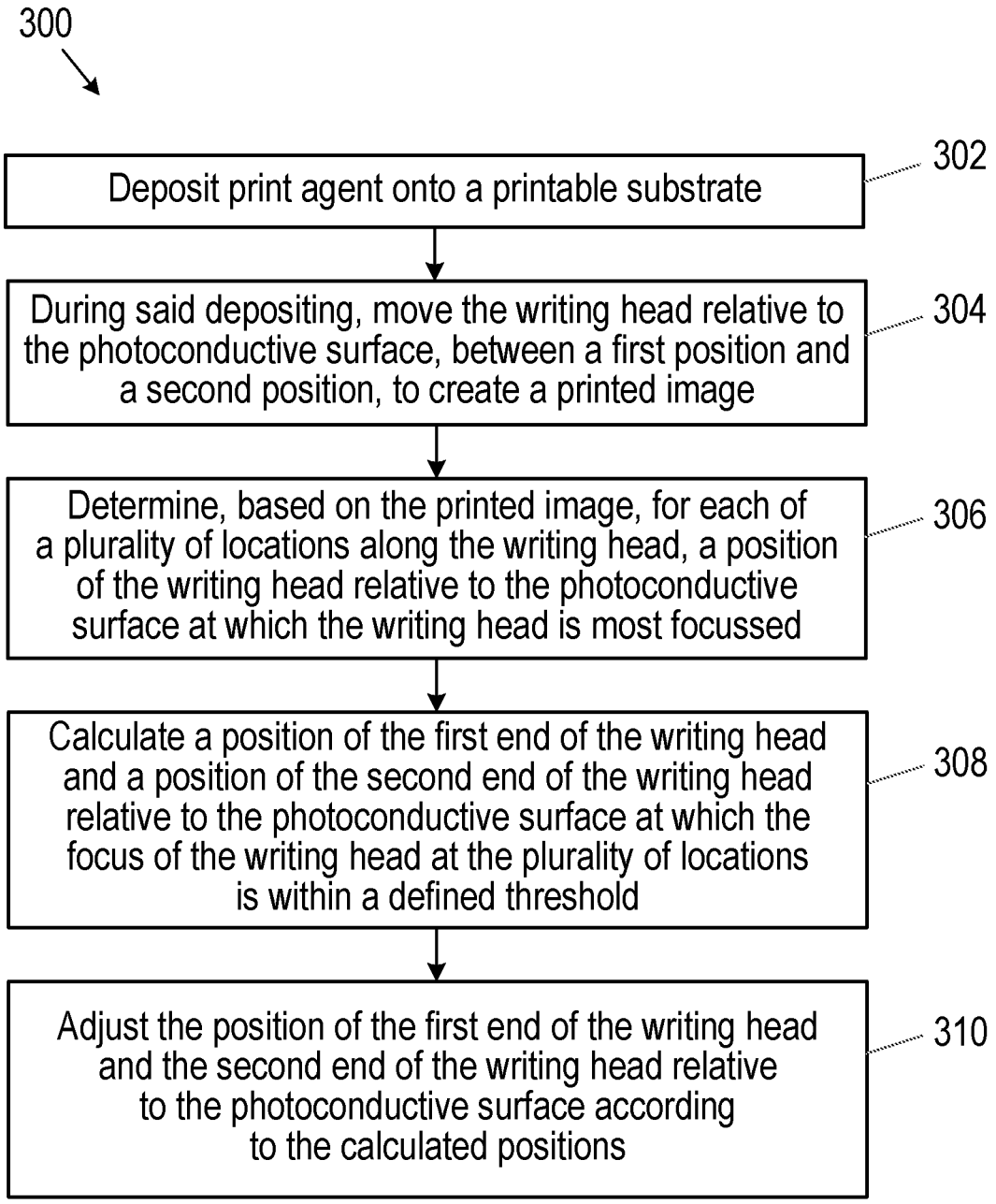
FIG. 3 is a flowchart of an example of a focus adjustment method.

FIG. 3 is a flowchart of an example of a focus adjustment method 300. The method 300 may, for example, be performed using the print apparatus 100. The method 300 comprises, at block 302, depositing, using a print apparatus 100, print agent onto a printable substrate 118, the print apparatus comprising a photoconductive surface 106 and a writing head 104 having a first end 104*a* and a second end 104*b*, the writing head having an array of light sources to emit radiation onto the photoconductive surface during a printing operation. The depositing (block 302) may, in some examples, comprise depositing a series of spots onto the printable substrate 118, as discussed above. For example, a uniform grey block or region may be printed using a digital halftone screen. In other examples, a uniform block of print agent of some other colour may be deposited. By using halftone printing, the printed output is in the form of the series of spots, enabling a distinction to be made between those spots resulting from in-focus light sources and those resulting from out-of-focus light sources. In other examples, a synthetic pattern (e.g. dots and/or lines) may be printed as part of the depositing of block 302. At block 304, the method 300 comprises, during said depositing (block 302), moving the writing head 104 relative to the photoconductive surface 106, between a first position 202 and a second position 204, to create a printed image. The printed image may, for example, comprise dark and light printed regions, such as those shown in regions 206 and 208 in FIG. 2. The first position 202 may comprise a distal position (e.g. a position at which the writing head 104 is at its furthest distance from the photoconductive surface 106) and the second position 204 may comprise a proximal position (e.g. a position at which the writing head 104 is at its closest to this photoconductive surface). It will be understood that the writing head 104 has a defined range of movement, and the terms "furthest" and "closest" used herein in the context of the distance between the writing head and the photoconductive surface are intended to describe the extremes of this range of movement. In some examples, the writing head 104 may be moved between the first position 202 and the second position 204 at a substantially constant rate. In some examples, the first position may comprise a position in which the first end and the second end of the writing head are at their furthest points from the photoconductive surface, and the second position may comprise a position in which the first end and the second end of the writing head are at their closest points to the photoconductive surface.

The method 300 comprises, at block 306, determining, based on the printed image, for each of a plurality of locations along the writing head 104, a position of the writing head relative to the photoconductive surface 106 at which the writing head is most focussed (e.g. the focus is optimal). In one example, the plurality of locations may include locations at or near to the ends 104*a*, 104*b* of the writing head 104. The determining of block 306 may be achieved, for example, by examining the printed image on the printable substrate 118 and identifying the locations at either side of the substrate where it can be seen, detected or measured that the printed image corresponds to positions in which radiation emitted from the light sources in the writing head was in focus. For example, with reference to FIG. 2, an in-focus position of the light sources at or nearest to the first end 104*a* of the writing head 104 corresponds to the region 210 in the unshaded region 208 of the printable substrate 118, and an in-focus position of the light sources at or nearest to the second end 104*b* of the writing head corresponds to the region 212 in the unshaded portion of the printable substrate. In some examples, the processor 102 may be able to determine the position of the first end 104*a* of the writing head 104 relative to the photoconductive surface 106 that gave rise to the printed region 210 and, similarly, the processor may be able to determine the position of the second end 104*b* of the writing head relative to the photoconductive surface that gave rise to the printed region 212. The determining of block 306 may be performed manually by a user or operator, who inspects the printed image and provides an indication (e.g. via a user interface) the position of the region printed with smallest spots across the width of the printable substrate, or automatically by scanning the printed image with a scanner, and using image analysis techniques to identify the regions printed with the smallest spots. Thus, the determining of block 306 may, in some examples, comprise visually inspecting the printed image, or measuring a reflectance at positions in the printed image using a scanner or densitometer. During a visual inspection, the lightest portions of the printed image correspond to the positions resulting from light sources when they were in focus. During an automatic inspection, using a scanner or densitometer, the reflectance may be measured at various points in the image, and a processor may be used to calculate the positions corresponding to the light sources when they were in focus.

Depending on the construction or assembly of the light sources on the writing head 104, the array of light sources, which may in some examples be formed as an array of light emitting diodes (LEDs), may extend substantially to the ends 104*a*, 104*b* of the writing head, or near to the ends. Thus, in some examples, the plurality of locations along the writing head 104 may comprise at least a location of a light source at an end of the array that is closest to the first end 104*a* of the writing head and a location of a light source at an end of the array that is closest to the second end 104*b* of the writing head. Thus, the position of the writing head relative to the photoconductive surface at which the writing head is most focussed (e.g. the focus is at an optimum level) may be determined for just the light sources at or closest to either end of the writing head. In other examples, the relative writing head position may be determined for additional light sources along the length of the writing head.

In some examples, it may be possible to correlate the position on the printable substrate 118 where the smallest spots of print agent are deposited (e.g. in the unshaded region 208 in FIG. 2) with light sources on the writing head 104 by using a position indicator or position ruler that may, for example, be marked on the printable substrate. For example, a position indicator (not shown) or multiple position indicators may be marked on the printable substrate 118. A position indicator may, for example, be marked along an edge or multiple edges of the printable substrate 118. A "horizontal" position indicator (e.g. an indicator, such as a ruler, extending across the printable substrate 118 in a direction perpendicular to the substrate movement direction) may enable a determination to be made of a corresponding position of the writing head 104 relative to the photoconductive surface 106 at various positions along the printable substrate 118. The position indicator may, for example, include markings every 10 mm. A "vertical" position indicator (e.g. an indicator, such as a ruler, extending across the printable substrate 118 in a direction parallel to the substrate movement direction) may be used to indicate a position of the writing head 104 relative to the photoconductive surface 106 at regular intervals in the printed image. Using such an indicator, each position along the image (i.e. in the substrate movement direction) may be translated to a position of the writing head 104 during the printing operation. The values in the position indicator may be set according to the defined movement of the writing head 104 by the position adjustment mechanism 120 (e.g. motors). In some examples, the position indicator may be printed onto the printable substrate 118 at the same time as the printed image. The position indicator may, in one example, form part of the printed image. When a scanner is used to analyse the printed image, the positions (both parallel to and perpendicular to the substrate movement direction) of points in the printed image may be determined, for example using image processing techniques.

Based on the determined positions for the plurality of locations along the writing head 104, a crude approximation of an appropriate position of the writing head relative to the photoconductive surface 106 may be determined. Such an appropriate position may, for example, be determined by moving the first end 104*a* and the second end 104*b* of the writing head 104 into positions corresponding to the best focus for the light sources at each end of the array of light sources. However, as noted above, other light sources in the light source array (e.g. light sources positioned between those at the ends of the array) may not be perfectly in focus at positions along a straight line between the light sources at the first and second ends 104*a*, 104*b*. Thus, at block 308, the method 300 comprises calculating, using processing apparatus (e.g. the processor 102), a position of the first end 104*a* of the writing head 104 and a position of the second end 104*b* of the writing head relative to the photoconductive surface 106 at which the focus of the writing head at the plurality of locations is within a defined threshold. Since the position of the writing head 104 relative to the photoconductive surface 106 can be adjusted just at its ends 104*a*, 104*b*, it is not possible to ensure that each light source in the light source array is in a position where it is most focused. Thus, the calculating of block 308 is intended to find an appropriate overall position which puts all (or as many as possible) of the light sources in a position where they are in focus or nearly in focus. The intention is to find a position where the light sources are focused to within a defined focus threshold or range which may, for example, comprise a threshold or range within which a human eye is unlikely to be able to detect a print defect or deficiency in the resulting image that is printed. In some examples, the defined threshold may comprise a threshold within which the focus of the writing head 104 is optimal. The defined threshold may comprise a threshold within which a focus error of the light sources each of the plurality of locations is minimized.

At block 310, the method 300 comprises adjusting the position of the first end 104*a* of the writing head 104 and the second end 104*b* of the writing head relative to the photoconductive surface 106 according to the calculated positions. Thus, once the writing head 104 has been moved (e.g. by the adjustment mechanism 120) into its intended position (e.g. an optimum position based on the focus of various positions along the writing head), future printing operations performed using the print apparatus 100 are less likely to include print defects resulting from out-of-focus light sources.

Figure 4A:
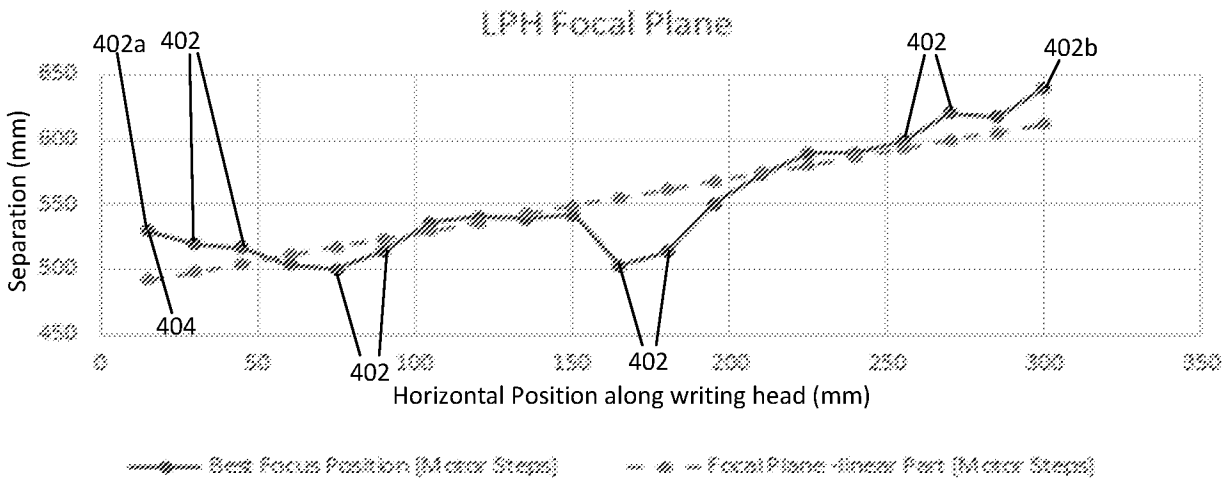
FIG. 4 is a pair of graphs showing an output of a focus adjustment process.

An example of the calculating (block 308) is described below with reference to FIG. 4, which shows two graphs representing an output of a focus adjustment process. FIG. 4A is a graph showing the points of best focus for twenty positions along the writing head 104. Each of the twenty positions along the writing head 104 is represented by a data point 402. Each point indicates a distance of the writing head 104 from the photoconductive surface 106 (e.g. a distance between the corresponding light source(s) at that position along the writing head and the photoconductive surface) when the corresponding light source(s) was most focused (i.e. the light source's best focus position). A line of best-fit 404 (otherwise referred to as a linear approximation) has been added to the graph in FIG. 4A based on the data points 402. The best-fit line 404 therefore represents an approximate focal plane of the writing head 104, and shows the position of the writing head 104 relative to the photoconductive surface 106.

Figure 4B:
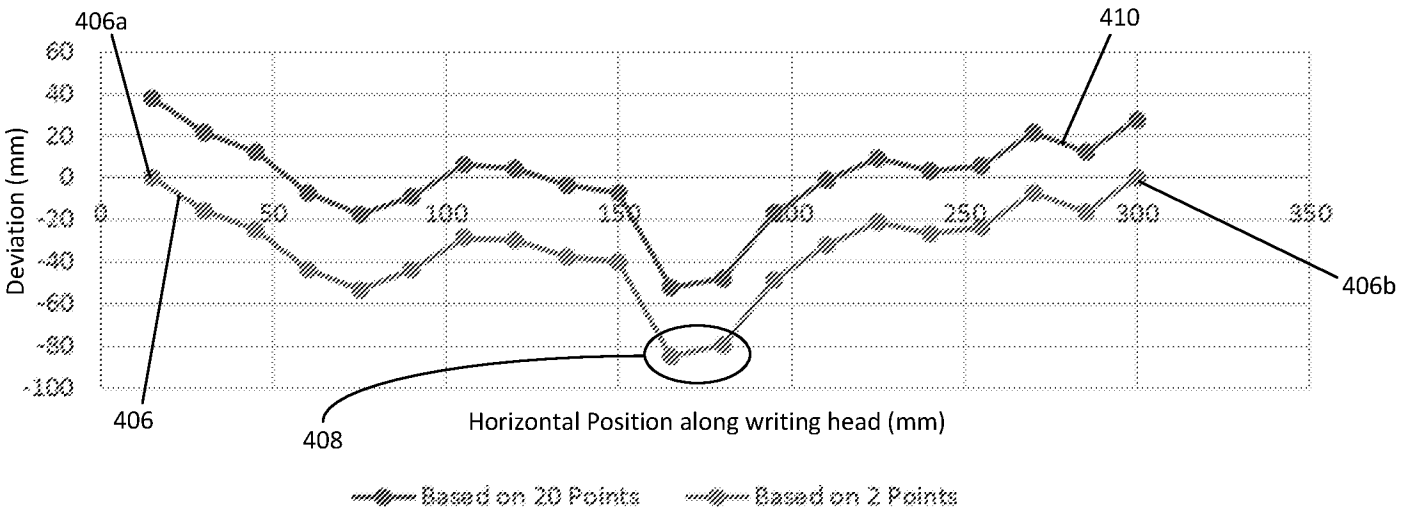

The effect of calculating the approximate focal plane based on the plurality of positions along the writing head 104 is shown in the graph of FIG. 4B. The line 406, which is based on the data points 402 from FIG. 4A, shows that, when light sources at nearest to the end positions the writing head 104 are in focus (shown by points 406*a* and 406*b*) other light sources on the writing head (e.g. see points 408) may have a focus error of around 80 μm. As discussed above, it may be intended that the focus error for any light source in the writing head (or for light sources at any position among the writing head) be kept below a defined threshold which, in some examples, may be around 50 μm. Therefore, based on the data shown in FIG. 4B, it may be possible to determine an adjustment of the distance of the writing 104 from the photoconductive surface 106 that results in the focus error of all of the points along the writing head being less than a defined threshold (or falling within a defined range) which, in this example, is 50 μm. The line 410 in the graph of FIG. 4B shows provide adjusting the position of the writing head 104 relative to the photoconductive surface 106 (e.g. by adjusting the positions of the ends 104*a*, 104*b* of the writing head), a writing head position may be achieved in which all of the points along the writing head are within the defined threshold.

Figure 5:
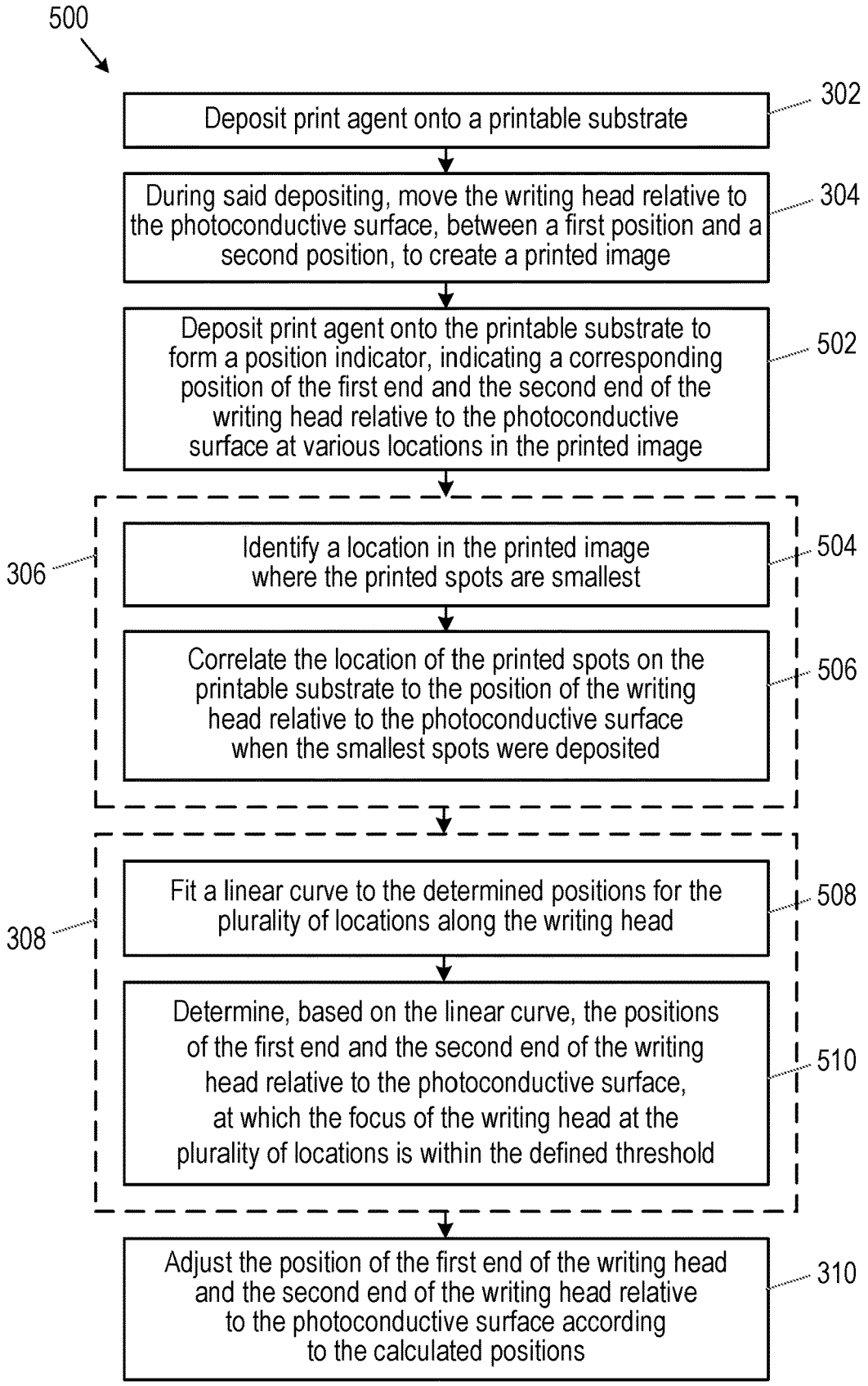
FIG. 5 is a flowchart of a further example of a focus adjustment method.

FIG. 5 is a flowchart of an example of a further focus adjustment method 500. The method 500 may include blocks of the method 300 discussed herein. The method 500 comprises the depositing (block 302) and moving (block 304) of the method 300 in some examples, the method 500 may comprise, at block 502, depositing, using the print apparatus, print agent onto the printable substrate 118 to form a position indicator, indicating a corresponding position of the first end 104*a* and the second end 104*b* of the writing head 104 relative to the photoconductive surface 106 at various locations in the printed image. As mentioned previously, the position indicator may, for example, take the form of a ruler the position indicator may printed at the same time as the printed image. Thus, box 302 and 502 may be performed concurrently.

As noted previously, print agent may be deposited (e.g. at block 302 of the method 300) onto the printable substrate 118 in a series of spots. In some examples, the determining (block 306 of the method 300) may comprise, at block 504, identifying a location in the printed image where the printed spots are smallest. The smallest printed spots may be considered to have resulted from light sources that were most focused on the photoconductive surface 106. The determining of block 306 may further comprise correlating the location of the printed spots on the printable substrate to the position of the writing head 104 relative to the photoconductive surface 106 when the smallest spots were deposited. The correlation may be made using a position indicator, such as the position indicator formed from the print agent deposited at block 502, as discussed above.

The calculating performed during block 308 of the method 300 may, in some examples, comprise, at block 508, fitting a linear curve to the determined positions for the plurality of locations along the writing head 104. Fitting a linear curve may be performed as discussed above with reference to FIGS. 4A and 4B. The calculating of block 308 may, in some examples, further comprise, at block 510, determining, based on the linear curve, the positions of the first end 104*a* and the second end 104*b* of the writing head 104 relative to the photoconductive surface 106, at which the focus of the writing head at the plurality of locations is within the defined threshold. In some examples, the determining of block 510 may comprise determining the positions of the ends of the writing head at which the overall focus error of the light sources of the writing head is minimised. The defined threshold may, in some examples, comprise a focal distance accuracy (also referred to as a focus error or focal distance error) of 50 μm.

Figure 6:
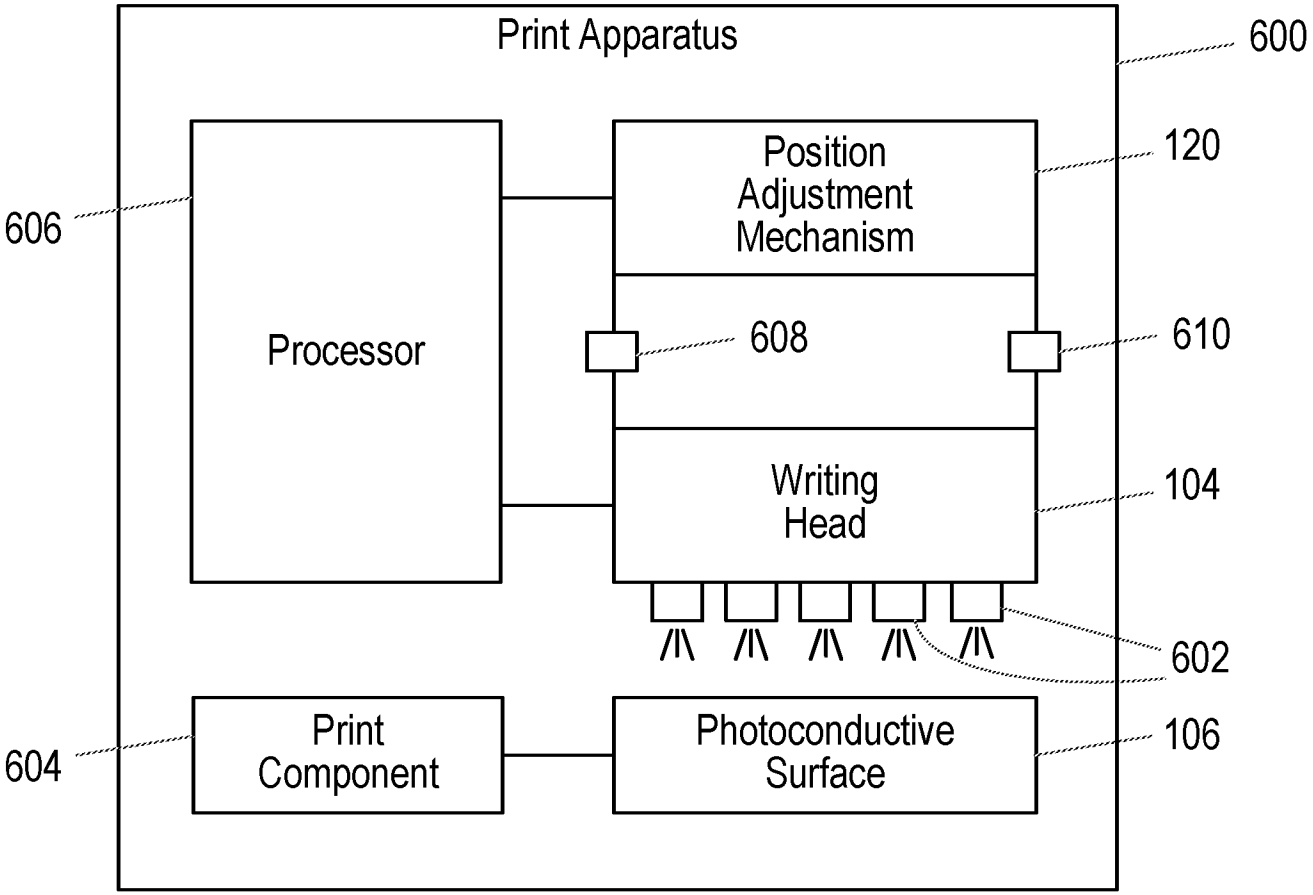
FIG. 6 is a schematic illustration of an example of a print apparatus.

FIG. 6 is a schematic illustration of an example of a print apparatus 600. The print apparatus 600 may be used to perform the blocks of the methods 300, 500 discussed herein. For clarity, reference numerals in FIG. 6 correspond to those used FIGS. 1 and 2. The print apparatus 600 comprises a photoconductive surface 106, a writing head 104. The writing head comprises a plurality of light sources 602 to emit radiation onto the photoconductive surface 106 during a printing operation. The writing head has a first end and a second end (104*a* and 104*b* in FIG. 2). The print apparatus 600 also comprises a print component 604 to transfer print agent onto a substrate to be printed during the printing operation. The print component 604 may, in some examples, comprise or include components such as the transfer medium 114 and the roller 116 (e.g. an intermediate transfer roller) as shown in FIG. 1. The print apparatus 600 also includes a position adjustment mechanism 120 to adjust a position of the first end (FIG. 2; 104*a*) and the second end (FIG. 2; 104*b*) of the writing head 104 relative to the photoconductive surface 106. The print apparatus 600 also comprises a processor 606 which may, in some examples, be in operable communication with other components of the print apparatus. The processor 606 is to control the writing head 104 and the print component 604 to perform a printing operation, to cause print agent to form a printed image on a substrate 118. The processor 606 is also to control the position adjustment mechanism 120 to adjust a position of the first end (FIG. 2; 104*a*) and the second end (FIG. 2; 104*b*) of the writing head 104 relative to the photoconductive surface 106, between a first position (FIG. 2; 202) and a second position (FIG. 2; 204), during the printing operation. The processor 606 is also to determine, based on the printed image, for each of a plurality of points along the writing head, 104 a distance between the writing head and the photoconductive surface 106 at which the writing head focus is optimal. The processor 606 is also to calculate a distance of the first end (FIG. 2; 104*a*) of the writing head 104 from the photoconductive surface 106 and a distance of the second end (FIG. 2; 104*b*) the writing head from the photoconductive surface at which the focus of the writing head at the plurality of points is within a defined focus range. The processor 606 is also to control the position adjustment mechanism 120 to adjust the distances of the first end (FIG. 2; 104*a*) and the second end (FIG. 2; 104*b*) of the writing head 104 from the photoconductive surface 106 according to the calculated distances.

The processor 606 may, in some examples, calculate the distances (i.e. the distances between the first and second ends of the writing head 104 and the photoconductive surface 106) by determining a linear best-fit of the determined distances for the plurality of points along the writing head; and determining, based on the linear best-fit, the distances of the first end and the second end of the writing head from the photoconductive surface, at which the focus of the writing head at the plurality of points is within the defined focus range. The defined focus range may be selected based on the intended use accuracy of the print apparatus and may, in some examples, comprise a focus range of 0 to 50 μm.

In some examples, in the first position (FIG. 2; 202) of the writing head 104, the first end (FIG. 2; 104*a*) and the second end (FIG. 2; 104*b*) of the writing head are at their maximum allowed distance from the photoconductive surface 106 and, in the second position (FIG. 2; 204) of the writing head, the first end and the second end of the writing head are at their minimum allowed distance from the photoconductive surface. The maximum and minimum distances may, for example, be based on the operable range of movement allowed by the position adjustment mechanism 120.

The position of the writing head 104 may be adjusted at 2 points; for example, either end of the writing head. Thus, according to some examples, the position adjustment mechanism may comprise a first motor 608 to adjust a position of the first end (FIG. 2; 104*a*) of the writing head 104; and a second motor 610 to adjust a position of the second end (FIG. 2; 104*b*) of the writing head. In other examples, components other than motors may be used to adjust the position of the writing head 104.

It will be apparent that the methods 300, 500 disclosed herein may be used to adjust focus positions in various types of print apparatus. In one example, the print apparatus 600 may comprise a liquid electrophotography (LEP) print apparatus.

Figure 7:
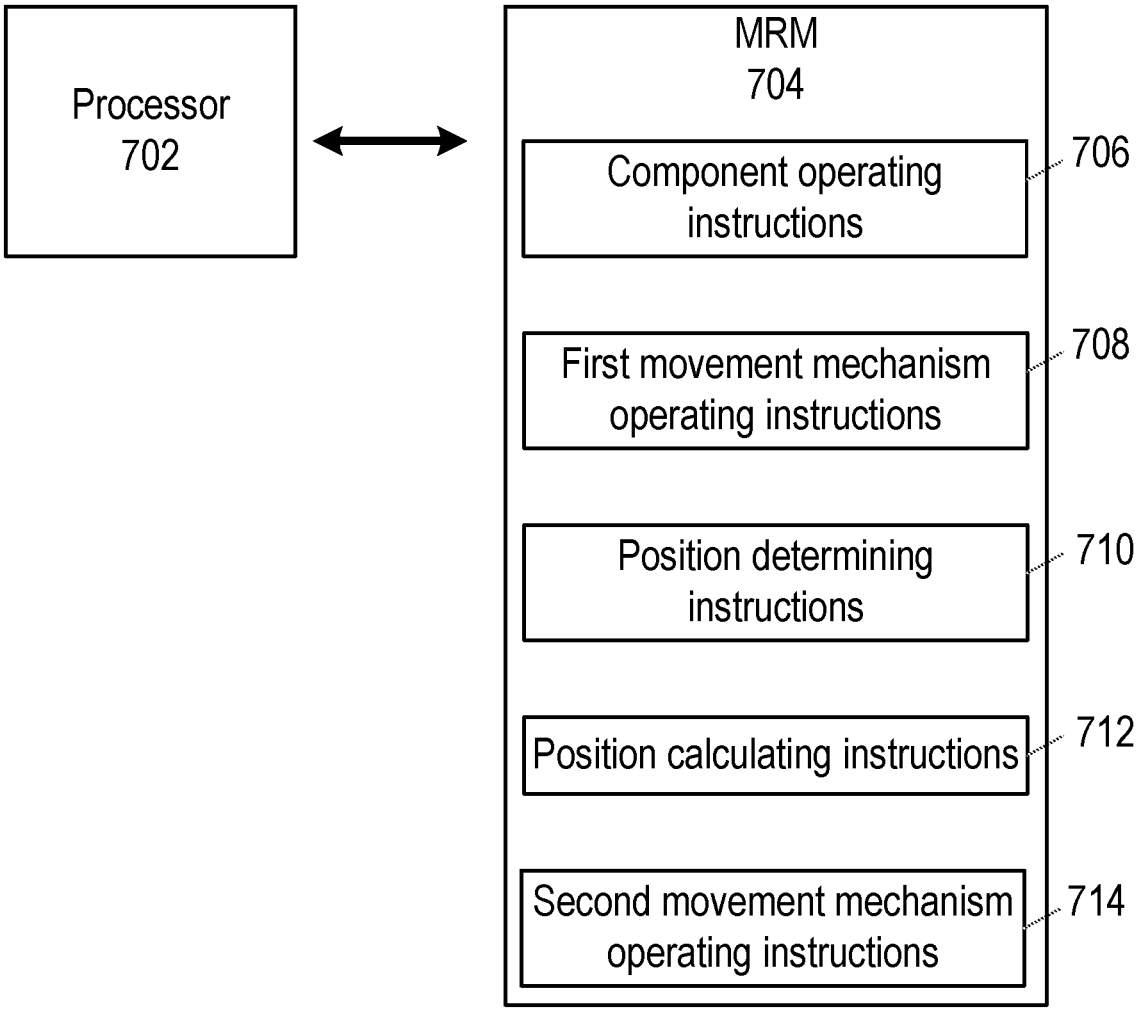
FIG. 7 is a schematic illustration of a processor in communication with a machine-readable medium.

FIG. 7 is a schematic illustration of a processor 702 in communication with a machine-readable medium 704. The machine-readable medium 704 comprises instructions 706 to 714 which, when executed by the processor 702, cause the processor to perform various tasks, such as those discussed in the methods 300, 500. The machine-readable medium 704 may comprise component operating instructions 706 which, when executed by the processor 702, cause the processor to operate components of a printing system to deposit print agent onto a printable substrate, the printing system comprising a photoconductive surface 106 and a light-emitting writing head 104, the writing head moveable between a distal position and a proximal position relative to the photoconductive surface, and having an array of light-emitting elements to emit radiation onto the photoconductive surface during a printing operation. The machine-readable medium 704 may comprise first movement mechanism operating instructions 708 which, when executed by the processor 702, cause the processor to operate a movement mechanism 120 to move the writing head 104 between the distal position and the proximal position while said print agent is deposited, to create a printed image. The machine-readable medium 704 may comprise position determining instructions 710 which, when executed by the processor 702, cause the processor to determine, based on the printed image, for each of a plurality of locations along the writing head 104, a position of the writing head 104 between the distal position and the proximal position at which the writing head focus is optimal. The machine-readable medium 704 may comprise position calculating instructions 712 which, when executed by the processor 702, cause the processor to calculate a position of the writing head 104 relative to the photoconductive surface at which the focus of the writing head at the plurality of locations is within a defined range. The machine-readable medium 704 may comprise second movement mechanism operating instructions 714 which, when executed by the processor 702, cause the processor to operate the movement mechanism 120 to move the writing head 104 relative to the photoconductive surface 106 according to the calculated position.

Thus, the methods, print apparatus and machine-readable medium disclosed herein provide a mechanism by which the positions of light sources used in a print apparatus may be adjusted to achieve an intended (e.g. optimum) focus accuracy for the light sources. Specifically, the disclosure enables a determination to be made of a position of a component (e.g. a writing head) relative to another component (e.g. a photoconductive surface) of the print apparatus at which a focus accuracy of all of the light sources meets or exceeds a defined threshold.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A focus adjustment method comprising:

depositing, using a print apparatus, print agent onto a printable substrate, the print apparatus comprising a photoconductive surface and a writing head having a first end and a second end, the writing head having an array of light sources to emit radiation onto the photoconductive surface during a printing operation;

during said depositing, moving the writing head relative to the photoconductive surface, between a first position and a second position, to create a printed image;

determining, based on the printed image, for each of a plurality of locations along the writing head, a position of the writing head relative to the photoconductive surface at which the writing head is most focused;

calculating, using processing apparatus, a position of the first end of the writing head and a position of the second end of the writing head relative to the photoconductive surface at which the focus of the writing head at the plurality of locations is within a defined threshold; and adjusting the position of the first end of the writing head and the second end of the writing head relative to the photoconductive surface according to the calculated positions.

2. A focus adjustment method according to claim 1, wherein the plurality of locations along the writing head comprise at least a location of a light source at an end of the array that is closest to the first end of the writing head and a location of a light source at an end of the array that is closest to the second end of the writing head.

3. A focus adjustment method according to claim 1, wherein the first position comprises a position in which the first end and the second end of the writing head are at their furthest points from the photoconductive surface, and the second position comprises a position in which the first end and the second end of the writing head are at their closest points to the photoconductive surface.

4. A focus adjustment method according to claim 1, wherein said calculating comprises:

fitting a linear curve to the determined positions for the plurality of locations along the writing head.

5. A focus adjustment method according to claim 4, wherein said calculating further comprises:

determining, based on the linear curve, the positions of the first end and the second end of the writing head relative to the photoconductive surface, at which the focus of the writing head at the plurality of locations is within the defined threshold.

6. A focus adjustment method according to claim 1, wherein depositing print agent comprises depositing a series of spots onto the printable substrate.

7. A focus adjustment method according to claim 6, wherein said determining comprises:

identifying a location in the printed image where the printed spots are smallest; and correlating the location of the printed spots on the printable substrate to the position of the writing head relative to the photoconductive surface when the smallest spots were deposited.

8. A focus adjustment method according to claim 1, wherein said determining comprises:

visually inspecting the printed image, or measuring a reflectance at positions in the printed image using a scanner or densitometer.

9. A print apparatus comprising:

a photoconductive surface;

a writing head comprising a plurality of light sources to emit radiation onto the photoconductive surface during a printing operation, the writing head having a first end and a second end;

a print component to transfer print agent onto a substrate to be printed during the printing operation;

a position adjustment mechanism to adjust a position of the first end and the second end of the writing head relative to the photoconductive surface; and a processor to:

control the writing head and the print component to perform a printing operation, to cause print agent to form a printed image on a substrate;

control the position adjustment mechanism to adjust a position of the first end and the second end of the writing head relative to the photoconductive surface, between a first position and a second position, during the printing operation;

determine, based on the printed image, for each of a plurality of points along the writing head, a distance between the writing head and the photoconductive surface at which the writing head focus is optimal;

calculate a distance of the first end of the writing head from the photoconductive surface and a distance of the second end of the writing head from the photoconductive surface at which the focus of the writing head at the plurality of points is within a defined focus range; and control the position adjustment mechanism to adjust the distances of the first end and the second end of the writing head from the photoconductive surface according to the calculated distances.

10. A print apparatus according to claim 9, wherein, in the first position of the writing head, the first end and the second end of the writing head are at their maximum allowed distance from the photoconductive surface and, in the second position of the writing head, the first end and the second end of the writing head are at their minimum allowed distance from the photoconductive surface.

11. A print apparatus according to claim 9, wherein the position adjustment mechanism comprises:

a first motor to adjust a position of the first end of the writing head; and a second motor to adjust a position of the second end of the writing head.

12. A print apparatus according to claim 9, wherein the print apparatus comprises a liquid electrophotography print apparatus.

13. A print apparatus according to claim 9, wherein the processor is to calculate said distances by:

determining a linear best-fit of the determined distances for the plurality of points along the writing head; and determining, based on the linear best-fit, the distances of the first end and the second end of the writing head from the photoconductive surface, at which the focus of the writing head at the plurality of points is within the defined focus range.

14. A machine-readable medium comprising instructions which, when executed by a processor, cause the processor to:

operate components of a printing system to deposit print agent onto a printable substrate, the printing system comprising a photoconductive surface and a light-emitting writing head, the writing head moveable between a distal position and a proximal position relative to the photoconductive surface, and having an array of light-emitting elements to emit radiation onto the photoconductive surface during a printing operation;

operate a movement mechanism to move the writing head between the distal position and the proximal position while said print agent is deposited, to create a printed image;

determine, based on the printed image, for each of a plurality of locations along the writing head, a position of the writing head between the distal position and the proximal position at which the writing head is most focused;

calculate a position of the writing head relative to the photoconductive surface at which the focus of the writing head at the plurality of locations is within a defined range; and operate the movement mechanism to move the writing head relative to the photoconductive surface according to the calculated position.

* * * * *